US005738589A

United States Patent [19]

Hall

[11] Patent Number: 5,738,589

[45] Date of Patent: Apr. 14, 1998

[54] RIDING TOY

[76] Inventor: Thomas A. Hall, 17300 SW. Rider La., Beaverton, Oreg. 97007

[21] Appl. No.: 680,185

[22] Filed: Jul. 15, 1996

[51] Int. Cl.[6] ..... A63G 13/08; A63H 33/00; A63B 21/04

[52] U.S. Cl. ..... 472/103; 446/29; 446/487; 482/130; 482/96

[58] Field of Search ..... 482/130, 123, 482/96; 472/95, 103, 104, 105, 135; 446/3, 7, 29, 486, 487

[56] References Cited

U.S. PATENT DOCUMENTS

| | | | |
|---|---|---|---|
| D. 170,026 | 7/1953 | Peltier | D34/15 |
| 208,531 | 10/1878 | Marqua . | |
| D. 213,988 | 4/1969 | Hall | D21/2 |
| 293,139 | 2/1884 | Bohlig . | |
| 542,871 | 7/1895 | Crandall . | |
| 2,218,333 | 10/1940 | Frisk | 272/52 |
| 2,241,465 | 5/1941 | Krempler | 272/52 |
| 2,302,239 | 11/1942 | McKinney | 272/52 |
| 2,506,890 | 5/1950 | Pratt | 472/104 |
| 2,529,017 | 11/1950 | Hall | 155/61 |
| 2,668,579 | 2/1954 | Swengel | 472/105 |
| 2,914,325 | 11/1959 | Cox | 472/105 |
| 3,379,438 | 4/1968 | Stewart | 272/52 |
| 4,351,522 | 9/1982 | Marburger et al. | 272/52 |
| 4,575,071 | 3/1986 | Swengel, Sr. et al. | 472/105 |
| 5,180,338 | 1/1993 | Pinto | 472/103 X |
| 5,507,709 | 4/1996 | Wu | 482/96 X |

FOREIGN PATENT DOCUMENTS

| | | | |
|---|---|---|---|
| 94035 | 4/1922 | Switzerland | 472/105 |

*Primary Examiner*—D. Neal Muir
*Attorney, Agent, or Firm*—William S. Lovell

[57] ABSTRACT

A riding toy for children includes safety shields and end plates to prevent access to a set of longitudinal springs that provides a restoring force when the toy is "ridden." Also, the use of wide vertical struts that rotate about axes passing there-through near to a side thereof causes contact to occur between a strut corner and the base of the toy at the lower end thereof, and between a strut corner and the bottom of the riding structure at the top thereof, thus to provide a natural limit to the degree to which the riding structure can be thrust forward or backward, and thereby serving to prevent tipping the toy entirely over. Such a limitation of motion can also be obtained by contact of upper and lower corners of the safety shields and the riding structure or base, respectively, or between mutually facing sides of the struts on either or both sides of the riding toy. The structure thus provides a "ride" in which the seat upon which a child is placed remains horizontal at all times, no contact can be made between the child and the springs that provide the restoring force to the toy, and natural limits to the range of motion are provided that are approached smoothly, against the force of the springs, whereby the child can enjoy any pre-selected range of motion, in accordance with pre-selected dimensions of the toy components that may be implemented within a particular embodiment of the toy, without danger of being jolted off from the toy.

9 Claims, 2 Drawing Sheets

Fig. 1
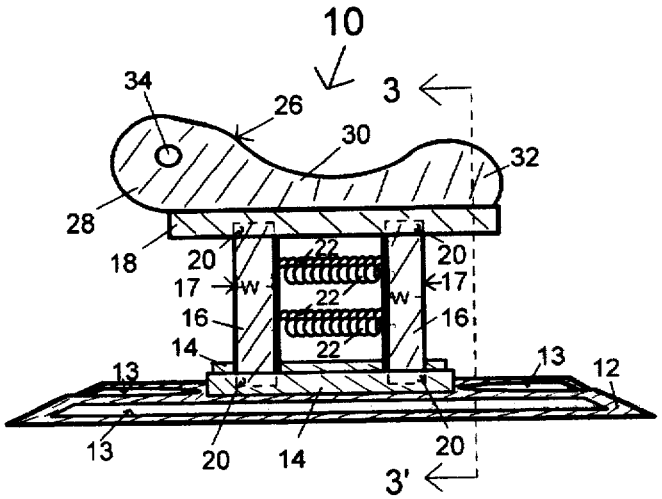
Fig. 2
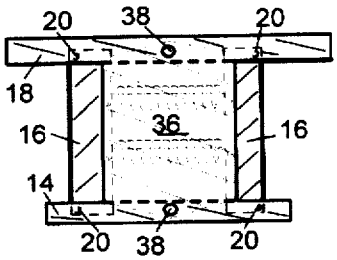
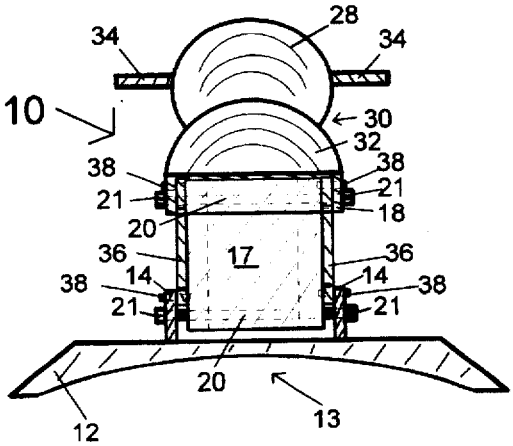
Fig. 3

RIDING TOY

BACKGROUND OF THE INVENTION

1. FIELD OF THE INVENTION

This invention relates to toys, particularly riding toys, and more specifically to spring-mounted toys upon which a child may sit and carry out a "ride" by way either of that child's own physical effort or of external impetus such as an adult giving "pushes" to the toy with the child mounted thereon.

2. BACKGROUND INFORMATION

It has long been the practice to provide various riding toys such as hobby horses and the like for the amusement and exercise of children. For example, U.S. Design Pat. No. D170,026 issued Jul. 14, 1953 to Peltier shows a riding toy mounted on a stand by way of four longitudinally-extending springs that interconnect between struts that extend outwardly from the riding toy and four corresponding pillars that are disposed in a rectangular pattern on the stand and extend upwardly therefrom. Another design patent, U.S. Design Pat. No. D213,988 issued Apr. 29, 1969 to Hall, the present inventor, shows a riding toy in the form of an airplane wherein the riding portion is mounted by way of springs that extend vertically downward from the "wing tips" thereof.

Another such riding toy structured using vertical spring mounts is described in U.S. Pat. No. 293,139 issued Feb. 5, 1884 to Bohlig, in which a sloping board extends from a first hinge at the bottom rear of a riding platform (simulating a horse) to a second hinge at the top front of an underlying, wheeled base, two coiled springs then respectively extending vertically between a region beneath that first hinge and the top rear of the base and between a region above that second hinge and the top front of the riding platform.

U.S. Pat. No. 2,241,465 issued May 13, 1941 to Krempler employs a single large coiled spring beneath a seat that is mounted to the rear of a structure made to resemble just the forward portion of a horse, whereby a child may bounce on the seat while keeping the feet fixed in position against that forward structure.

U.S. Pat. No. 3,379,438 issued Apr. 23, 1968 to Stewart employs three vertically-extending coil springs, i.e., two such springs attached respectively parallel near to the front of a riding platform, and a third such spring disposed towards the rear of the platform in line with a center point between those first two springs, all of such springs being mounted at lower ends thereof onto posts that extend upward from a base.

U.S. Pat. No. 2,218,333 issued Oct. 18, 1940 to Frisk discloses a riding toy wherein a hollowed-out horse-like structure has a first frame essentially in the form of two parallel and longitudinally separated inverted U's that are fixedly attached within the interior thereof. A box-like second frame fixed to a platform extends upwardly into the interior of that first frame, and a set of four springs at respective corners o that second frame connect at distal ends thereof near to the bottom-most portions of those inverted U's, whereby the first frame becomes spring-mounted to the second frame. Connected to the apexes of such inverted U's are two relatively large vertically-extending springs that at the lower ends are mounted onto a plate-like surface disposed at the top of the second frame, thus to serve as shock-absorbing springs.

U.S. Pat. No. 2,302,239 issued Nov. 17, 1942 to McKinney describes a riding toy having a riding seat within a base frame, the seat being rotatably connected by way of vertical struts to axles extending across the frame. Extending transversely between both front and back pairs of such struts are second axles to which are rotatably mounted stirrup-like structures, and between rollers disposed at the inwardly facing ends of those stirrup-like structures is a resilient belt that provides a restoring force when the seat is moved.

U.S. Pat. No. 4,351,522 issued Sep. 28, 1982 to Marburger et al. describes a riding toy that essentially comprises a stick horse mounted at a fulcrum at a point somewhat rearward to the longitudinal center thereof, a coil spring then being attached to the rear end of the stick horse downwardly to a base, whereby a bouncing motion imposed at a seat near to the front of the stick horse becomes restored by action of that spring.

U.S. Pat. No. 208,531 issued Oct. 1, 1878 to Marqua describes a riding toy in which a long base has two vertical posts centrally mounted near to the front and back thereof, a long, narrow frame is fixedly attached atop those vertical posts, and rotatably attached near to the front and rear ends of that frame are inverted U structures, the arms of which extend downwardly on each side to connect rotatably to longitudinal bars on each side that are in turn rotatably attached to the hooves of a replica horse, i.e., one bar extends between the left front hoof and the left rear hoof, and the other to the right front and right rear hooves. The replica horse attaches only at the hooves to those bars, which are free to undergo forward and backward motion by virtue of their rotatable attachment by the inverted U structures to the aforesaid frame. Such motion causes an upward raising of the horse so that gravity provides the necessary restoring force.

U.S. Pat. No. 542,871 issued Jul. 16, 1895 to Crandall provides a restoring force to a riding motion by way of a counterweight: a hollow box-like base has front and back cross-members to which are rotatably attached vertical struts, which in turn are rotatably attached to the underside of a replica horse. Longitudinally central between those vertical struts there is rotatably attached rod to which is likewise rotatably attached a large counterweight, so that a rocking motion of the replica horse in either direction is restored by the weight of the counterweight.

Finally, U.S. Pat. No. 2,529,017 issued Nov. 7, 1950, to the present inventor T. A. Hall, describes a riding platform mounted by four swivel struts that are rotatably attached in a rectangular pattern to a base structure, the restoring force needed to counter a rocking motion of the platform being provided by a vertical spring that is rotatably attached at a proximal end to a central point on the underside of the platform, and at the distal end thereof to a cord which passes through a tube to connect centrally to the base. The inner surface of the upper, outlet portion of that tube curves outwardly to the lip thereof, whereby the cord is enabled to curve smoothly around the lip of that tube at either side thereof, as that cord may be pulled forward and backward by the rocking motion of the platform.

From the foregoing, it is apparent that a number of attempts have been made to provide riding toys to children, variations in which have centered mostly on the means selected to provide a restoring force so that any motion of the riding platform will be turned in the opposite direction so that a "ride" may continue. Some such efforts may raise safety concerns, e.g., the mounting of springs to externally exposed struts as in the Peltier device may present a danger should a child fall upon them from atop the horse. The Bohlig or Crandall devices may be overly massive and weighty, while others may provide too much freedom of movement to a small child, as perhaps does Stewart, or very limited movement, as perhaps do Krempler and Marburger, et al. It would thus be of advantage to provide a riding toy that had a natural limit to its range of motion, for safety reasons, but without needing to introduce massive shock absorbers to do so, as in Frisk.

SUMMARY OF THE INVENTION

The invention comprises an apparatus in the form of a spring-mounted toy adapted to provide amusement and exercise for children who may carry out "rides" thereon. Coil springs are disposed to provide a restoring force to effectuate such rides, wherein those coil springs are surrounded by external shields which prevent a child from being pinched thereby or having a finger caught therein. By rotation of vertical struts about transverse axes near to the base at the bottom and the riding structure at the top, the riding structure itself is caused to remain parallel to the base and make it less likely that a child might fall therefrom. For additional safety purposes the toy has a broad base, which includes cut-out portions for lighter weight, and also provides a limit to the extent of riding motion so that a child is again less likely to fall off the toy.

BRIEF DESCRIPTION OF THE DRAWINGS

The preferred embodiments of the invention will now be described in detail with reference to the accompanying drawings, in which:

FIG. 1 is a slightly oblique side elevation view of a preferred embodiment of the riding toy wherein internal springs are exposed to view.

FIG. 2 is side elevation view of a portion of the riding toy of FIG. 1 in which is also shown a safety shield covering over the internal springs.

FIG. 3 is a cross-sectional view of the riding toy of FIG. 1 taken through the lines 3—3'.

DETAILED DESCRIPTION OF THE INVENTION

Figure 4:
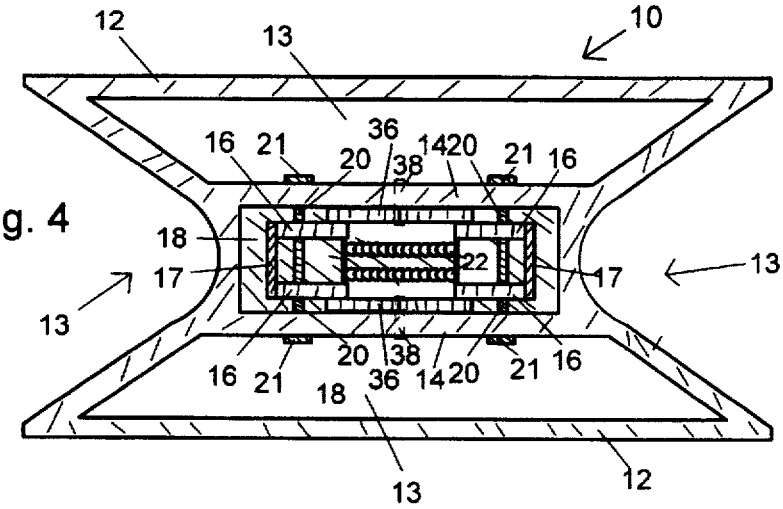
FIG. 4 is a bottom plan view of the toy of FIG. 1.

FIG. 1 depicts a riding toy 10 having a rectangular base 12 including cut-out portions 13 for lighter weight, and braces 14 fixedly mounted longitudinally onto base 12 in a mutually parallel relationship. Rotatably mounted onto braces 14 are mutually parallel pairs of struts 16 of width W, one strut 16 within each pair being so mounted at proximal ends thereof to each of said braces 14, and said pairs of struts being disposed in forward and rearward positions along braces 14. End plates 17 (one of which is best seen in FIG. 3) attach between paired struts 16 at outwardly facing sides thereof. The distal ends of struts 16 are rotatably mounted to platform 18. All such rotatable mountings are accomplished by means of pairs of transverse axles 20 that extend respectively between braces 14 at proximal ends of struts 16 and between opposite sides of platform 18 at distal ends of struts 16, at respective forward and rearward positions. Axles 20 pass through struts 16 at positions that are substantially "off-axis," by which is meant that a substantially greater portion of the full strut width W extends inwardly (i.e., from one strut 16 towards the second strut 16 on a side) than outwardly (i.e., outward from riding toy 10 in either a forward or rearward direction). Attached parallel to each of braces 14 and near to mutually facing edges of struts 16 are one or more coil springs 22, there preferably being two pairs of such springs 22 disposed in respectively higher and lower positions, thereby to provide a restoring force when toy 10 is being ridden upon as will be described hereinafter. Mounted atop platform 18 is a riding structure 26, typically in the form of a replica of a horse, a jet plane or the like, and comprising a forward portion 28, a seat portion 30 near the middle of riding structure 26 shaped for comfortable use in the usual manner, and a rearward portion 32. Extending outwardly on each side of forward portion 28 are handles 34 that may be grasped by a child riding toy 10.

FIG. 2 depicts a fragment of riding toy 10, including braces 14, struts 16, platform 18, and axles 20. Not shown in FIG. 1 for purposes of clarity but now shown in FIG. 2 is a generally rectangular safety shield 36 having triangular ends, there being a similar safety shield 36 similarly disposed on the opposite side of toy 10, each of which safety shields 36 is rotatably attached near the apex of each triangular end thereof by axles 38 to a base 14 at the lower end and a corresponding side of platform 18 at the upper end. In the operation of toy 10, safety shields 36 carry out a sliding motion relative to each of braces 14, struts 16 and platform 20, and in so doing cover over the interior of toy 10 wherein are disposed springs 22 that might cause injury to a child.

For purposes of additional clarity, FIG. 3 shows in rear elevation a cutaway view of riding toy 10, taken through the lines 3—3' of FIG. 1, and particularly showing base 12, one cut-out portion 13, braces 14, one end plate 17, and a view of both safety shields 36 as disposed between end plate 17 (which defines the region having springs 22 therebehind) and inward faces of braces 14 at the lower end and platform 18 at the upper end. In addition, FIG. 3 shows optional end caps 21, which may be attached by force fit or other convenient means, that cover over the ends of axles 20 so as to protect the same from access by a child. The precise structure by which axles 20 serve to interconnect braces 14, struts 16 and platform 18 is not critical to the invention, so long as a like structure is accomplished whereby safety shields are mounted so as to preclude access to springs 22 by childish fingers. The structure of handles 34 is also shown more clearly in this view.

FIG. 4 shows a bottom plan view of the toy of FIG. 1 in which, for example, the under side of platform 18 can be seen through the structure defined by struts 16, end plates 17, and safety shields 36. Axles 38 that connect safety shields 36 to a base 14 at a lower end and a corresponding side of platform 18 at an upper end are shown generically, and may comprise a simple wire passing through said components and bent to remain in place.

Figure 5:
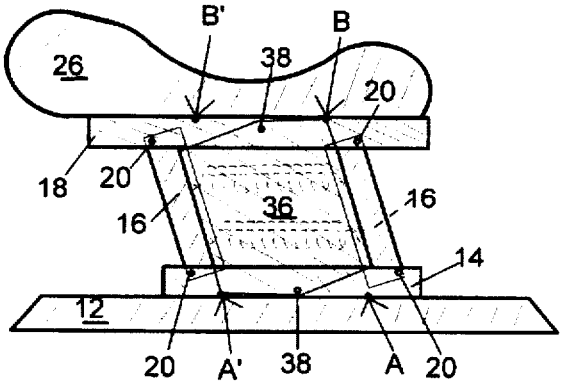
FIG. 5 is a side elevation view of the toy of FIG. 1 in a conformation in which the riding platform thereof has been moved forward as in a "ride" to show two alternative means of providing a stop to the extent of motion.

FIG. 5 now shows in a side elevation view the conformation of toy 10 at a time that platform 18 had been thrust forward, as in the course of a "ride" by a child. Riding structure 26 may be seen to have remained parallel to base 12 (and hence to a floor upon which base 12 may be placed), thereby avoiding the danger that a child might fall over the front of forward portion 28, or might slide off the rearward portion 32, of riding structure 26. It may also be noted that (1) springs 22 have been elongated so as to provide a restoring force; and (2) safety shield 36 has been rotated at each end thereof at axles 38, while remaining in a disposition that covers over the region containing springs 22. Moreover, a natural stopping point in the indicated forward thrust is provided, of which two examples are shown.

Specifically, the "off-axis" placement of axles 20 near to outward vertical sides of struts 16, together with provision of a substantial width W to struts 16, necessitates that at a particular point in such forward motion, a bottom-left corner of rearward struts 16 will come up against the upper surface of base 12 as at point A shown in FIG. 5, thereby stopping such forward motion. From FIG. 5, it is clear that the same will occur in a rearward motion as to the bottom-right corner of forward struts 16 near point A', thereby similarly limiting the extent of rearward motion. These limitations on motion serve to prevent a child from tipping toy 10 entirely over, either forwardly or rearwardly. The actual extent of such motion that one may wish to allow may be preestablished by such means as defining the width W of struts 16 or in setting the height of axles 20 above base 12.

A second method for limiting the range of motion of toy 10 employs safety shields 36. As shown in FIG. 5, rotation of safety shield 36 causes an upper right "corner", i.e., the rightward end of the upper triangular end thereof, to come into contact with the bottom side of riding structure 26 near to point B. In a rearward motion of riding structure 26, the corresponding leftward end of that upper triangular end of shield 36 would come into contact with the bottom side of riding structure 26 near to the point B'. As FIG. 5 is drawn, it is apparent that in a forward motion the leftward end of the bottom triangular end of shield 36 may likewise come into contact with base 12 near to point A', and similarly that in a rearward motion the rightward end of the bottom triangular end of shield 36 may come into contact with base 12 near to point A. Thus, by adjustment in the angle at which the ends of shield 36 are pointed or in the width of shield 36, the designer of a particular embodiment of the invention is given additional means to establish the extent of forward or backward motion of toy 10 that would be possible. In the absence of such features, and but for yet another feature noted below, a forward or backward motion could continue to a point riding structure 26 would have been placed sufficiently forward or rearward of base 12 as to cause the same to tip forwards or backwards.

Figure 6:
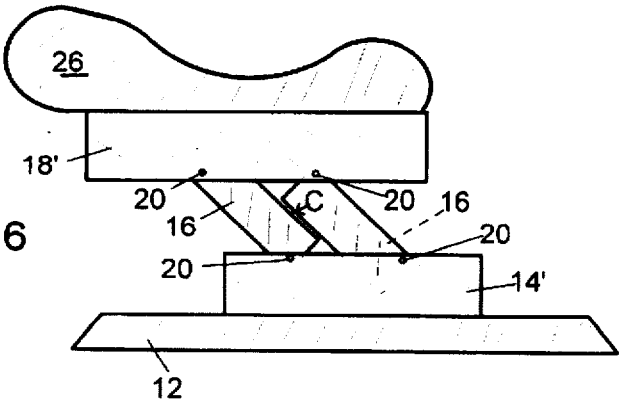
FIG. 6 is a side elevation view of the toy of FIG. 1 similar to that of FIG. 5, but in which alternative beams and platform are used to implement yet a third means of providing a stop to the extent of motion.

Yet a third means of limiting the extent of motion is shown in FIG. 6, in which for clarity of illustration neither springs 22 nor safety shields 36 are shown, and in which are shown alternative braces 14' and alternative platform 18' which differ from their counterparts braces 14 and platform 18 of FIG. 5 in having a substantially greater vertical dimension. The effect of that vertical dimension is that upon a forward (or of course a rearward) motion of the riding platform and concomitant rotation of struts 16 and shields 36, neither struts 16 nor shields 36 come into contact either with base 12 or platform 18 (i.e., in this case platform 18'), but instead the mutually facing sides of a foreward-disposed strut 16 and a rearward-disposed strut 16 come into contact along face C, thereby precluding further motion. It is apparent from FIG. 6 that in a similar rearward motion of the riding platform, those inward-facing sides of struts 16 would come into contact in regions thereon opposite to those shown in FIG. 6, i.e., such contact would occur along an upper region of the forward strut and a lower region of the rearward strut. This third method of limiting the possible range of motion is similar to the first in that it depends in part upon (1) struts 16 having a substantial width W, and (2) struts 16 are mounted "off-axis," so as to leave the most part of strut 16 to participate either in striking a base 12 as in the first method of limiting motion or for the mutually facing portions of two struts to come into contact. In any of these three methods of providing a limit to the range of motion, it is not to be supposed that such limits are struck abruptly so as to provide any likelihood of dislodging a child, inasmuch as the positions at which such limits would be encountered are attained only against the tension of springs 22, so that the speed at which those limits are encountered is quite minimized. The conceptual basis for the invention thus includes provision for "tailoring" the construction of any particular embodiment thereof to provide permissible motions of a desired extremity.

It will be understood by those of ordinary skill in the art that other arrangements and disposition of the aforesaid components, the descriptions of which are intended to be illustrative only and not limiting, may be made without departing from the spirit and scope of the invention, which must be identified and determined only from the following claims and equivalents thereof.

I claim:

1. A riding toy comprising:

a base having a longitudinal extension, a transverse extension, a lower surface and an upper surface;

a pair of beam-like braces fixedly attached to said upper surface in a mutually parallel relationship along said longitudinal extension, and extending in a transverse dimension of said braces vertically upward from said base;

at least two pairs of struts extending upwardly and being rotatably attached in a mutually parallel relationship having mutually facing sides to respective forward and rearward positions along said longitudinal extension to said pair of braces, the members of each said pair of struts being mutually parallel, and one each of each of said pairs of struts being attached at proximal ends thereof to one each of said pair of braces;

a platform having a top surface and downwardly-extending, longitudinally extending and mutually parallel sides rotatably attached near forward and rearward ends thereof to distal ends of said at least two pairs of struts, one each of said mutually parallel sides being so attached to one each of said members of each said at least two pairs of struts;

a riding structure having a longitudinal extension and a transverse extension and being fixedly mounted in a longitudinal disposition along said top surface of said platform;

at least one spring rotatably attached in a nearly horizontal disposition between said corresponding mutually facing sides of at least one member of each of said at least two pairs of struts; and a pair of planar safety shields each having an elongate, nearly vertical extension and an extension transverse to said nearly vertical extension, each of said safety shields being rotatably attached at an upper end thereof to respective ones of said downwardly-extending sides of said platform, and being rotatably attached at lower ends thereof to a corresponding one of said braces, in each case at a longitudinal disposition between said forward and rearward positions, said nearly vertical extension and said extension transverse thereto being of sufficient dimension to cover over respective regions between each of said at least two pairs of struts.

2. The riding toy of claim 1 further comprising at least two planar end pieces each having an elongate, nearly vertical extension and an extension transverse to said nearly vertical extension, one each of said end pieces being attached respectively to outwardly surfaces of each of said at least two pairs of struts, said nearly vertical extension and transverse extensions being of sufficient dimension to cover over respective regions between said members of each of said at least two pairs of struts, whereby said at least one spring will have become fully covered over.

3. The riding toy of claim 1 wherein at least one of said at least two pairs of struts has a sufficient extension in the longitudinal dimension of said riding toy that upon rotation of each of said at least two pairs of struts in at least one predetermined direction about said rotatable attachments thereof, a lower corner of said at least one of said at least two pairs of struts will be caused to come into contact with said upper surface of said base, thereby precluding further rotation of said at least two pairs of struts in said at least one predetermined direction.

4. The riding toy of claim 2 wherein at least one of said at least two pairs of struts has a sufficient extension in the longitudinal dimension of said riding toy that upon rotation of each of said at least two pairs of struts in at least one predetermined direction about said rotatable attachments thereof, a lower corner of said at least one of said at least two pairs of struts will be caused to come into contact with said upper surface of said base, thereby precluding further rotation of said at least two pairs of struts in said at least one predetermined direction.

5. The riding toy of claim 1 wherein at least one of said at least two pairs of struts has a sufficient extension in the longitudinal dimension of said riding toy that upon rotation of each of said at least two pairs of struts in either direction about said rotatable attachments thereof, at least one lower corner of said at least one of said at least two pairs of struts will be caused to come into contact with said upper surface of said base, thereby precluding further rotation of said at least two pairs of struts in either selected one of said either directions.

6. The riding toy of claim 2 wherein at least one of said at least two pairs of struts has a sufficient extension in the longitudinal dimension of said riding toy that upon rotation of each of said at least two pairs of struts in either direction about said rotatable attachments thereof, at least one lower corner of said at least one of said at least two pairs of struts will be caused to come into contact with said upper surface of said base, thereby precluding further rotation of said at least two pairs of struts in either selected one of said either directions.

7. The riding toy of claim 2 wherein said transverse extension of at least one of said safety shields is sufficient that upon rotation of said at least one of said safety shields in at least one predetermined direction about said rotatable attachments thereof, at least one upper corner of said at least one of said safety shields will come into contact with said lower surface of said platform, thereby precluding further rotation of said safety shields in said at least one predetermined direction.

8. The riding toy of claim 2 wherein said transverse extension of at least one of said safety shields is sufficient that upon rotation of said at least one of said safety shields in either direction about said rotatable attachments thereof, at least one upper corner of said at least one of said safety shields will come into contact with said lower surface of said platform, thereby precluding further rotation of said safety shields in either selected one of said either directions.

9. A riding toy comprising:

a base having a longitudinal extension, a transverse extension, a lower surface and an upper surface;

a pair of beam-like braces fixedly attached to said upper surface in a mutually parallel relationship along said longitudinal extension, and extending in a transverse dimension of said braces vertically upward from said base;

at least two pairs of struts extending upwardly and being rotatably attached in a mutually parallel relationship having mutually facing sides to respective forward and rearward positions along said longitudinal extension to said pair of braces, the members of each said pair of struts being mutually parallel, and one each of each of said pairs of struts being attached at proximal ends thereof to one each of said pair of braces;

a platform having a top surface and downwardly-extending, longitudinally extending and mutually parallel sides rotatably attached near forward and rearward ends thereof to distal ends of said at least two pairs of struts, one each of said mutually parallel sides being so attached to one each of said members of each said at least two pairs of struts;

a riding structure having a longitudinal extension and a transverse extension and being fixedly mounted in a longitudinal disposition along said top surface of said platform;

at least one spring rotatably attached in a nearly horizontal disposition between said corresponding mutually facing sides of at least one member of each of said at least two pairs of struts;

wherein at least one set of mutually facing members of such one or more pairs of struts on at least one side of said toy have a width disposed inwardly from the positions of said rotational attachments sufficient, upon rotation of said one or more pairs of struts in at least one direction, to cause contact to occur between said at least one set of mutually facing members, at a predetermined angle of rotation, whereby no further such rotation can occur.

* * * * *